US010345754B2

(12) United States Patent
Shiga

(10) Patent No.: US 10,345,754 B2
(45) Date of Patent: Jul. 9, 2019

(54) SHEET CONVEYING DEVICE AND IMAGE FORMING APPARATUS INCORPORATING THE SHEET CONVEYING DEVICE

(71) Applicant: Yuuki Shiga, Kanagawa (JP)

(72) Inventor: Yuuki Shiga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 170 days.

(21) Appl. No.: 15/593,030

(22) Filed: May 11, 2017

(65) Prior Publication Data

US 2017/0343955 A1 Nov. 30, 2017

(30) Foreign Application Priority Data

May 25, 2016 (JP) ..... 2016104718

(51) Int. Cl.
*G03G 15/00* (2006.01)
*G03G 21/16* (2006.01)
*B65H 5/06* (2006.01)

(52) U.S. Cl.
CPC ..... *G03G 21/1623* (2013.01); *B65H 5/062* (2013.01); *G03G 15/6529* (2013.01); *G03G 21/1633* (2013.01); *G03G 21/1695* (2013.01); *B65H 2402/441* (2013.01); *B65H 2403/53* (2013.01); *B65H 2404/1341* (2013.01); *B65H 2404/144* (2013.01); *B65H 2601/11* (2013.01); *B65H 2601/325* (2013.01); *G03G 2215/00544* (2013.01)

(58) Field of Classification Search
CPC ..... B65H 5/062; B65H 2400/441; B65H 2601/325; B65H 2601/11; B65H 2403/53; B65H 2404/1341; B65H 2404/144; G03G 15/6529; G03G 21/1623; G03G 16/33; G03G 21/1695; G03G 2215/00544
See application file for complete search history.

(56) References Cited

U.S. PATENT DOCUMENTS 8,923,746 B2 * 12/2014 Nakamura ..... G03G 21/1638 399/121
9,310,724 B2 * 4/2016 Fukuda ..... G03G 15/2028
(Continued)

FOREIGN PATENT DOCUMENTS

JP 2006-039336 2/2006
JP 2006-178089 7/2006
(Continued)

*Primary Examiner* — Leslie J Evanisko
*Assistant Examiner* — Marissa Ferguson-Samreth
(74) *Attorney, Agent, or Firm* — Duft & Bornsen, PC

(57) ABSTRACT

A sheet conveying device, which is included in an image forming apparatus, includes first and second sheet conveying bodies to contact each other, a cover to move relative to an apparatus body of the image forming apparatus, and a connecting body to connect the cover and the second sheet conveying body. The second sheet conveying body separates from the first sheet conveying body along with an opening movement of the cover. The connecting body includes a first connecting portion connected to the cover and a second connecting portion connected to the second sheet conveying body. At least one of a connection with the cover and a connection with the second sheet conveying body is released when the cover is closed. The connecting body is brought into connection with the cover or the second sheet conveying body.

10 Claims, 8 Drawing Sheets

(56) References Cited

U.S. PATENT DOCUMENTS

| | | | | |
|---|---|---|---|---|
| 9,856,099 | B2 * | 1/2018 | Aoyama | B65H 3/06 |
| 9,983,535 | B2 * | 5/2018 | Ozawa | G03G 15/6529 |
| 2010/0098473 | A1 * | 4/2010 | Hosoi | B65H 5/38 399/400 |
| 2016/0116880 | A1 * | 4/2016 | Yoshida | B65H 5/062 399/367 |
| 2018/0127223 | A1 * | 5/2018 | Horita | B65H 3/0638 |
| 2018/0208419 | A1 * | 7/2018 | Mizuta | B65H 5/36 |

FOREIGN PATENT DOCUMENTS

| | | | | |
|---|---|---|---|---|
| JP | 2011-059441 | | 3/2011 | |
| JP | 2011-107253 | | 6/2011 | |
| JP | 2011-137998 | | 7/2011 | |
| JP | 2012-187723 | | 10/2012 | |
| JP | 2013-095545 | | 5/2013 | |
| JP | 2013-184754 | | 9/2013 | |
| JP | 2013180899 | * | 9/2013 | B65H 5/06 |
| JP | 2013-216448 | | 10/2013 | |
| JP | 2014-202991 | | 10/2014 | |
| JP | 2015011299 | * | 1/2015 | G03G 21/16 |
| JP | 2015-083506 | | 4/2015 | |

* cited by examiner

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2016-104718, filed on May 25, 2016, in the Japan Patent Office, the entire disclosure of which is hereby incorporated by reference herein.

BACKGROUND

Technical Field

This disclosure relates to a sheet conveying device and an image forming apparatus incorporating the sheet conveying device.

Related Art

Known image forming apparatuses include a sheet conveying device provided with a cover. When paper jam occurs in a sheet conveyance passage, a jammed sheet or sheets can be removed from a sheet conveyance passage by moving the cover that is openable and closable with respect to an apparatus body of the image forming apparatus and opening the sheet conveyance passage.

As an example, a known image forming apparatus has a function of releasing a nip region of a pair of sheet conveying roller disposed in the sheet conveyance passage by moving together with movement of a cover that opens and closes relative to an apparatus body of the know image forming apparatus. Specifically, the sheet conveying device includes a driven roller and a roller support member. The driven roller contacts and separates from a drive roller and forms a pair of sheet conveying rollers together with the drive roller. The roller support member rotatably supports the driven roller and is rotatably supported by the cover. In this configuration, as the cover opens, the driven roller moves in a direction to separate together with the roller support member from the drive roller. Consequently, the driven roller separates from the drive roller, and therefore the nip region is opened (canceled).

However, in the known image forming apparatus, a constant distance between a support to support the roller support member on the cover and a support to support the driven roller on the roller support member is determined based on a length of the roller support member. For this reason, a change of a position of the support to support the roller support member on the cover relative to the apparatus body of the known image forming apparatus due to part accuracy and assembly accuracy causes a change of a position of the driven roller supported by the cover via the roller support member. This leads to a change of the position of the driven roller to the drive roller when forming the nip region, thereby failing to obtain a desired nip pressure.

SUMMARY

At least one aspect of this disclosure provides a sheet conveying device including a first sheet conveying body, a second sheet conveying body, a cover, and a connecting body. The first sheet conveying body is configured to rotate and apply a conveying force to a sheet. The second sheet conveying body is configured to contact the first sheet conveying body and to form a nip region together with the first sheet conveying body. The cover is configured to open and close with respect to an apparatus body of an image forming apparatus. The second sheet conveying body is configured to separate from the first sheet conveying body along with an opening movement of the cover. The connecting body is configured to connect the cover and the second sheet conveying body. The connecting body includes a first connecting portion connected to the cover and a second connecting portion connected to the second sheet conveying body. At least one of a connection of the cover and the first connecting portion of the connecting body and a connection of the second sheet conveying body and the second connecting portion of the connecting body is released when the cover is closed with respect to the apparatus body of the image forming apparatus. The connecting body is brought into connection with either one of the cover and the second sheet conveying body.

Further, at least one aspect of this disclosure provides an image forming apparatus including the above-described sheet conveying device and an image forming device configured to form an image on the sheet conveyed by the sheet conveying device.

DETAILED DESCRIPTION

Figure 1A:
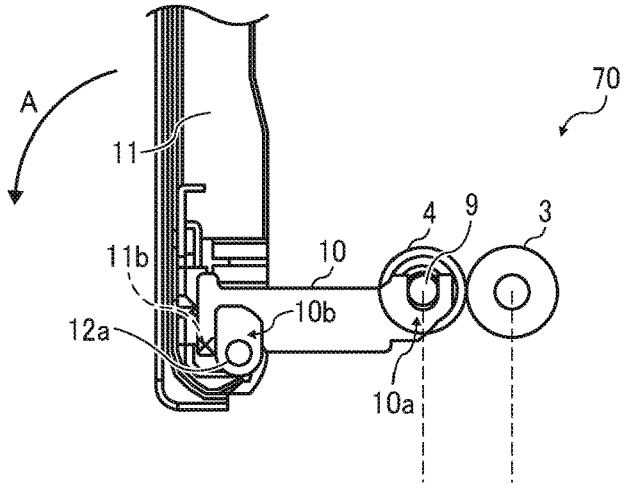
FIG. 1A is a diagram illustrating a connecting member and a sheet conveying driven roller that move together with movement of opening of a cover in a pre-registration sheet conveying device when the cover is in a closed state.

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration and functions of an image forming apparatus according to an embodiment of this disclosure, with reference to drawings.

It is to be noted that identical parts are given identical reference numerals and redundant descriptions are summarized or omitted accordingly.

Now, a description is given of an electrophotographic image forming apparatus 100 for forming images by electrophotography.

At first, a description is given of a basic configuration of the image forming apparatus 100 according to an embodiment of this disclosure.

Figure 2:
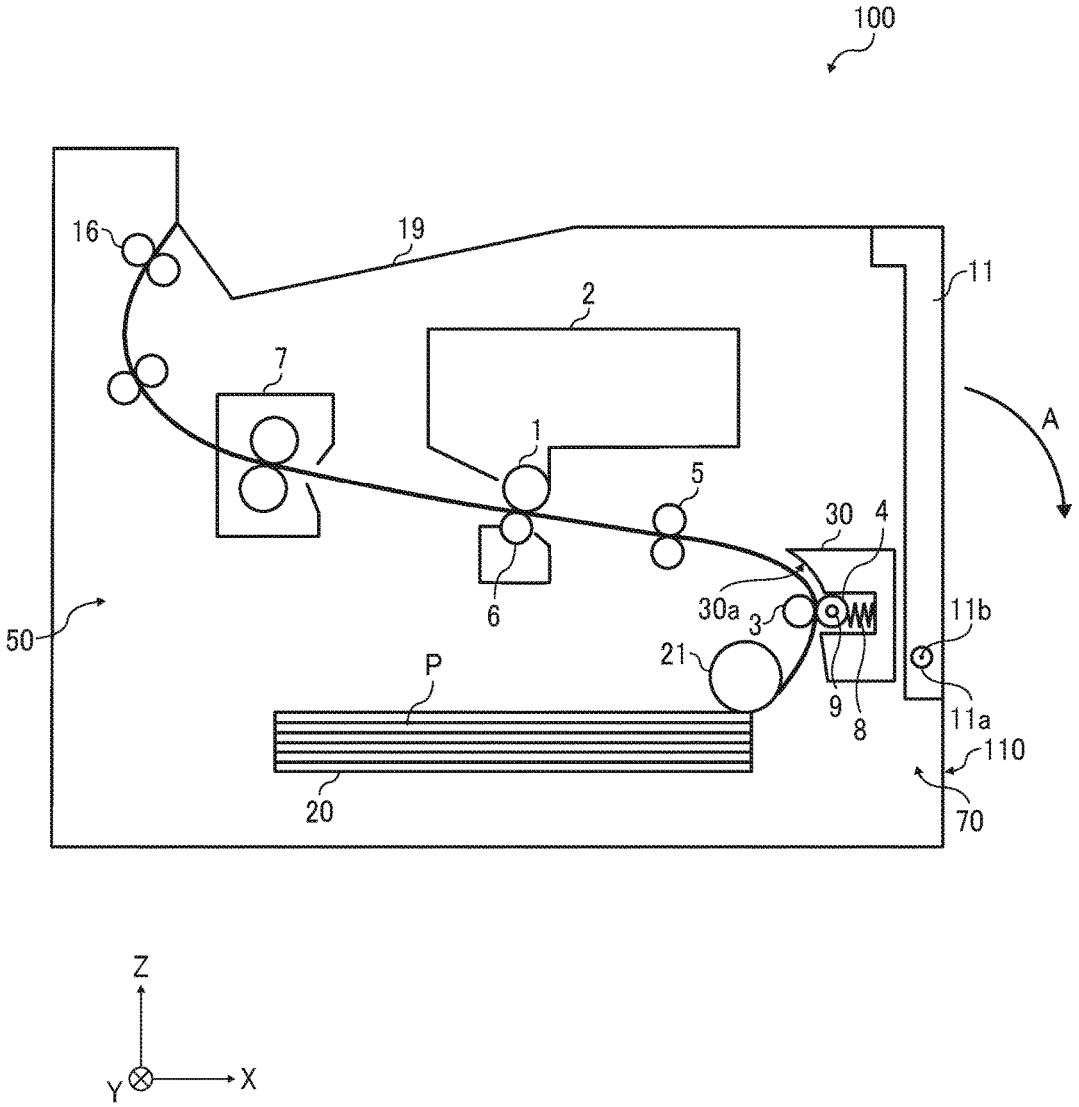
FIG. 2 is a schematic diagram illustrating an image forming apparatus according to an embodiment of this disclosure.

FIG. 2 is a diagram illustrating a schematic configuration of the image forming apparatus 100 according to the present embodiment of this disclosure.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying passage to a downstream side thereof; the term "width direction" indicates a direction basically perpendicular to the sheet conveying direction.

As illustrated in FIG. 2, the image forming apparatus 100 includes a photoconductor 1, an image forming section 2, a transfer device 6, and a fixing device 7. The photoconductor 1 functions as a latent image bearer. The image forming section 2 forms a toner image on a surface of the photoconductor 1. The transfer device 6 transfers the toner image formed on the surface of the photoconductor 1 onto a sheet P. The fixing device 7 fixes the toner image transferred onto the sheet P to the sheet P. The photoconductor 1, the image forming section 2, the transfer device 6, and the fixing device 7 form an image forming device 50 that forms an image on the sheet P that functions as a recording medium.

When the image forming apparatus 100 performs image formation, an exposure device included in the image forming section 2 forms a latent image on a surface of the photoconductor 1, and a developing device also included in the image forming apparatus 100 develops the latent image formed on the surface of the photoconductor 1 into a visible toner image on the surface of the photoconductor 1.

By contrast, the sheet P of a bundle of sheets loaded on a sheet feed tray 20 is conveyed one by one by a sheet feed roller 21. The sheet P then passes a sheet conveyance nip region defined by a sheet conveying drive roller 3 and a sheet conveying driven roller 4 and travels forward until the sheet P abuts against a pair of registration rollers 5.

Then, the pair of registration rollers 5 rotates in synchronization with movement of the toner image formed on the surface of the photoconductor 1 arriving a transfer position located facing the transfer device 6, so that the toner image formed on the surface of the photoconductor 1 is transferred onto the surface of the sheet P at the transfer position. The sheet P that has the toner image thereon is then conveyed to the fixing device 7 where the toner image on the surface of the sheet P is fixed to the sheet P by application of heat and pressure. Thereafter, the sheet P is discharged by a pair of sheet output rollers 16 to a sheet output tray 19 located outside an apparatus body 110 of the image forming apparatus 100.

In the image forming apparatus 100, the sheet conveying drive roller 3 and the sheet conveying driven roller 4, by both of which the sheet conveyance nip region is formed, and a contact and separation mechanism 200 to contact and separate the sheet conveying drive roller 3 and the sheet conveying driven roller 4 form a pre-registration sheet conveying device 70.

As illustrated in FIG. 2, the image forming apparatus 100 includes a cover 11 disposed on a right side face in FIG. 2, which is a front face of the image forming apparatus 100. The cover 11 is rotatable about a cover rotary axis 11*b* that is a center of a cover rotary shaft 11*a*. In a case in which a paper jam (a failure in sheet conveyance) occurs while the sheet P is being conveyed in a sheet conveyance passage inside the image forming apparatus 100, as the cover 11 is rotated in a direction indicated by arrow A in FIG. 2, the cover 11 opens to expose the sheet conveyance passage, thereby removing a jammed sheet or jammed sheets.

The image forming apparatus 100 illustrated in FIG. 2 further includes a pressure spring 8 that functions as a biasing member. The pressure spring 8 biases the sheet conveying driven roller 4 toward the sheet conveying drive roller 3 with a biasing force, so that the sheet conveyance nip region is generated between the sheet conveying drive roller 3 and the sheet conveying driven roller 4. In a case in which the paper jam occurs while the sheet P is being held in the sheet conveyance nip region, the jammed sheet P held in the sheet conveyance nip region cannot be removed easily.

In addition, when a user attempts forced removal of the jammed sheet P, the jammed sheet P is torn to remain in the image forming apparatus 100, which makes sheet removal difficult or impossible. The image forming apparatus 100 illustrated in FIG. 2 causes the sheet conveying driven roller 4 from the sheet conveying drive roller 3 along with opening and closing movement of the cover 11.

As illustrated in FIG. 2, the image forming apparatus 100 further includes a guide face forming member 30 functions as a guide. The guide face forming member 30 forms a guide face 30*a* that defines a sheet conveyance passage near the sheet conveyance nip region. The guide face forming member 30 does not move along with the opening and closing movement of the cover 11 and remains fixed to the apparatus body 110 of the image forming apparatus 100 even when the cover 11 is opened. The guide face forming member 30 also functions as a retainer that retains the sheet conveying driven roller 4 and the pressure spring 8.

Figure 3:
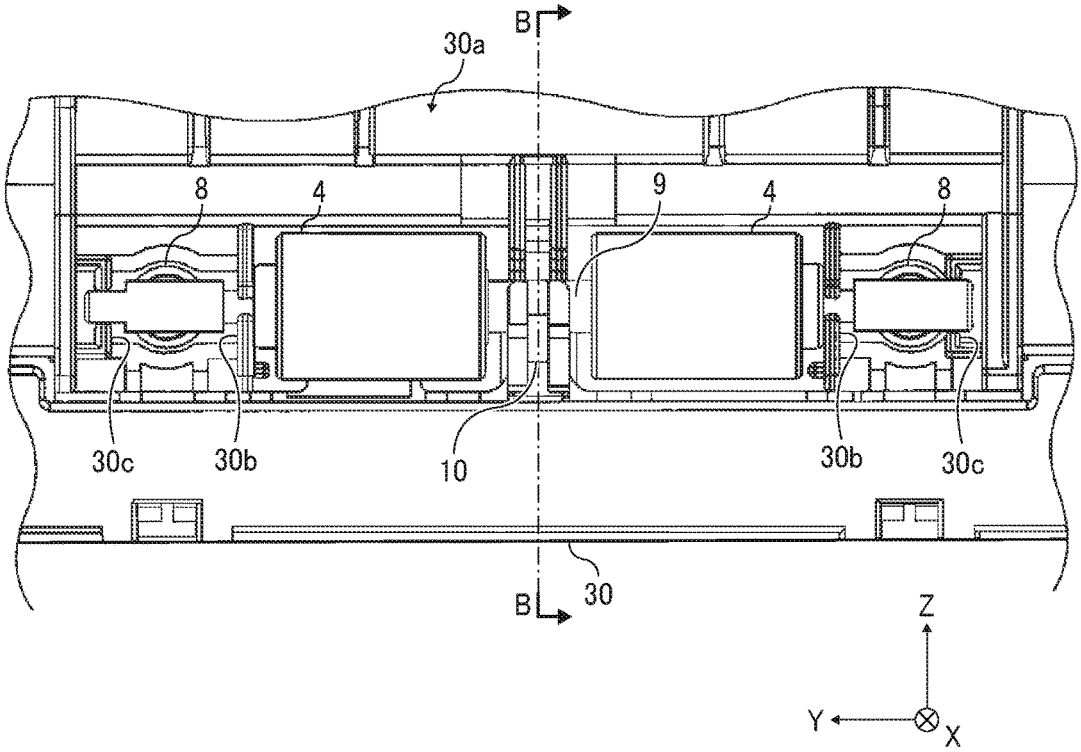
FIG. 3 is a diagram illustrating a guide face forming member viewed from a guide face.
Figure 4:
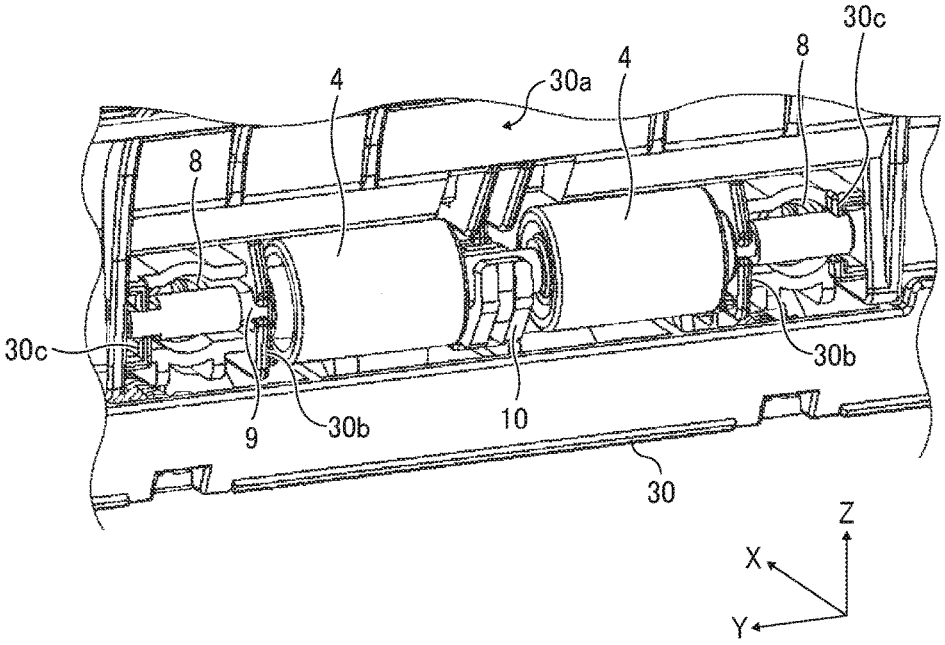
FIG. 4 is a perspective view illustrating the guide face forming member.
Figure 5:
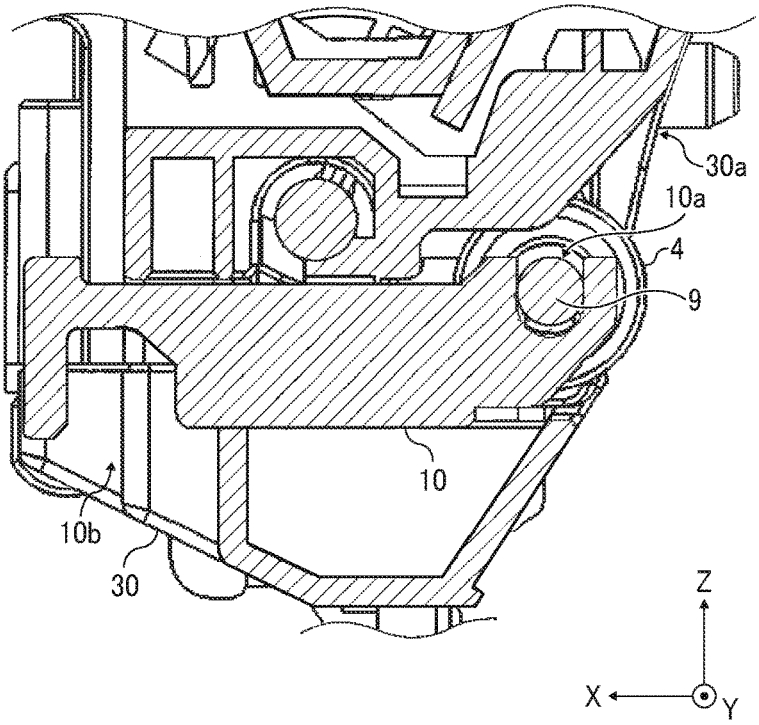
FIG. 5 is a cross sectional view illustrating the guide face forming member.
Figure 6:
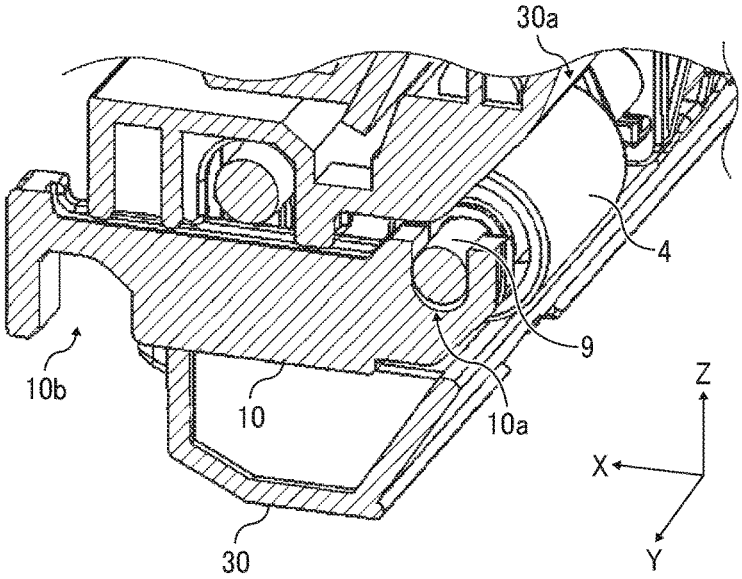
FIG. 6 is a perspective cross sectional view illustrating the guide face forming member.

FIG. 3 is a diagram illustrating the guide face forming member 30 viewed from the guide face 30*a*. FIG. 4 is a perspective view illustrating the guide face 30*a* of the guide face forming member 30 viewed from an obliquely upper side. FIG. 5 is a cross sectional view illustrating the guide face forming member 30 along a line of B-B of FIG. 3. FIG. 6 is a perspective cross sectional view illustrating the guide face forming member 30 along the line of B-B of FIG. 3.

The sheet conveying driven roller 4 is biased by the pressure spring 8 toward the sheet conveying drive roller 3 via a roller holding shaft 9. The pressure spring 8 is a compression spring. In FIG. 3, one end on the front side of the pressure spring 8 abuts against the roller holding shaft 9 and an opposite end on the rear side of the pressure spring 8 abuts against a spring contact face formed in the guide face forming member 30.

The guide face forming member 30 includes a roller retaining shaft guide rail portion 30*c* and a roller retaining shaft abutting portion 30*b*. The roller retaining shaft guide rail portion 30*c* regulates movement of the roller holding shaft 9 in the vertical direction (e.g., a Z-axis direction) in FIG. 3 and slidably retains the roller holding shaft 9 in a depth direction (e.g., an X-axis direction) in FIG. 3. Further, the guide face forming member 30 includes a roller retaining shaft abutting portion 30*b* that regulates movement of the roller holding shaft 9 toward the front side of the image forming apparatus 100 in FIG. 3.

The roller retaining shaft guide rail portion 30*c* also regulates movement of the sheet conveying driven roller 4 in the vertical direction relative to the guide face forming member 30. Further, the opposite end on the rear side of the pressure spring 8 contacts the spring contact face of the guide face forming member 30, then the pressure spring 8 presses the roller holding shaft 9 toward the front side of the image forming apparatus 100, and therefore the roller holding shaft 9 abuts against the roller retaining shaft abutting portion 30*b*. Consequently, the movement of the sheet conveying driven roller 4 in the depth direction in FIG. 3 relative to the guide face forming member 30 is regulated. With this configuration in which the sheet conveying driven roller 4 is regulated relative to the guide face forming member 30 as described above, a position of the sheet conveying driven roller 4 on the guide face forming member 30 is so regulated.

The regulation of the roller holding shaft 9 by abutting the roller retaining shaft abutting portion 30*b* is performed to a state before the guide face forming member 30 is attached to the apparatus body 110 of the image forming apparatus 100. Once the guide face forming member 30 is attached to the apparatus body 110 of the image forming apparatus 100, the sheet conveying driven roller 4 contacts the sheet conveying drive roller 3 to form the sheet conveyance nip region, and therefore the roller holding shaft 9 separates from the roller retaining shaft abutting portion 30*b*.

As illustrated in FIGS. 3 and 4, the image forming apparatus 100 includes two sheet conveying driven rollers 4 to the roller holding shaft 9. The image forming apparatus 100 further includes a connecting member 10 attached to the roller holding shaft 9 between the two sheet conveying driven rollers 4 to connect the two sheet conveying driven rollers 4. As illustrated in FIGS. 5 and 6, the guide face forming member 30 has a through hole that penetrates the guide face forming member 30 in the horizontal depth direction in FIG. 3, which is a left-and-right direction in FIG. 5. The connecting member 10 is disposed to penetrate the through hole. Then, the connecting member 10 is movably held in the horizontal depth direction in FIG. 3 relative to the guide face forming member 30, which is the left-and-right direction in FIG. 5.

The connecting member 10 is a member that pulls the sheet conveying driven roller 4 along with the opening and closing movement of the cover 11, so as to separate the sheet conveying driven roller 4 from the sheet conveying drive roller 3.

Figure 7:
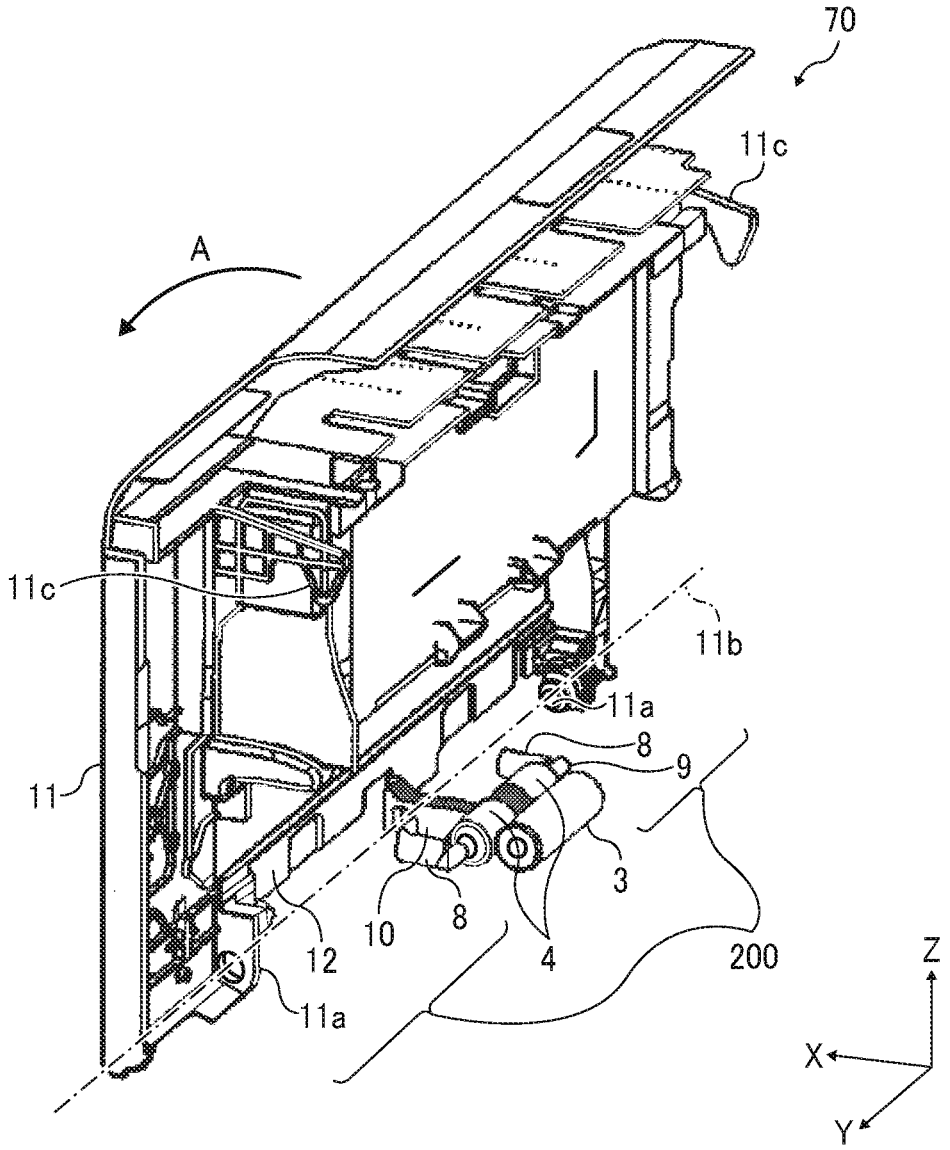
FIG. 7 is a perspective view illustrating the pre-registration sheet conveying device when the cover is in the closed state.
Figure 8:
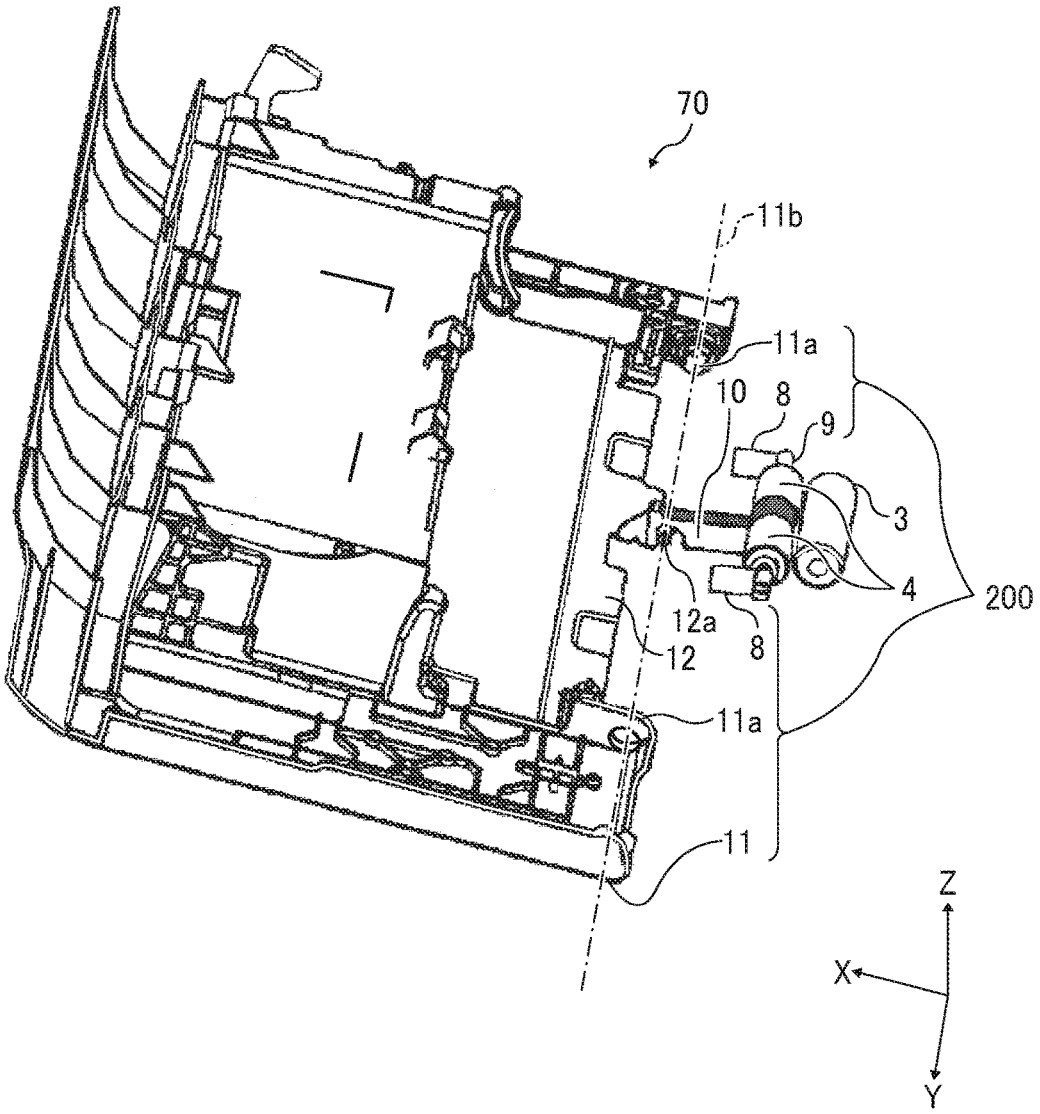
FIG. 8 is a perspective view illustrating the pre-registration sheet conveying device when the cover is in the open state.

Now, a description is given of a configuration in which the connecting member 10 pulls the sheet conveying driven roller 4 along with the opening and closing movement of the cover 11, with reference to FIGS. 7 and 8. FIG. 7 is a perspective view illustrating the cover 11, the connecting member 10, the sheet conveying drive roller 3, and the sheet conveying driven roller 4 of the pre-registration sheet conveying device 70 when the cover 11 is in the closed state, viewed from the far side of FIG. 2. FIG. 8 is a perspective view illustrating the cover 11, the connecting member 10, the sheet conveying drive roller 3, and the sheet conveying driven roller 4 of the pre-registration sheet conveying device 70 when the cover 11 is in the open state, viewed from the far side of FIG. 2. It is to be noted that the guide face forming member 30 is not illustrated in FIGS. 7 and 8 for convenience.

As illustrated in FIGS. 7 and 8, the cover 11 includes a nip releasing member 12 that functions as a nip releasing body that pulls the connecting member 10 along with the movement of opening the cover 11 and separates the sheet conveying driven roller 4 from the sheet conveying drive roller 3 against the biasing force applied by the pressure spring 8.

Figure 9:
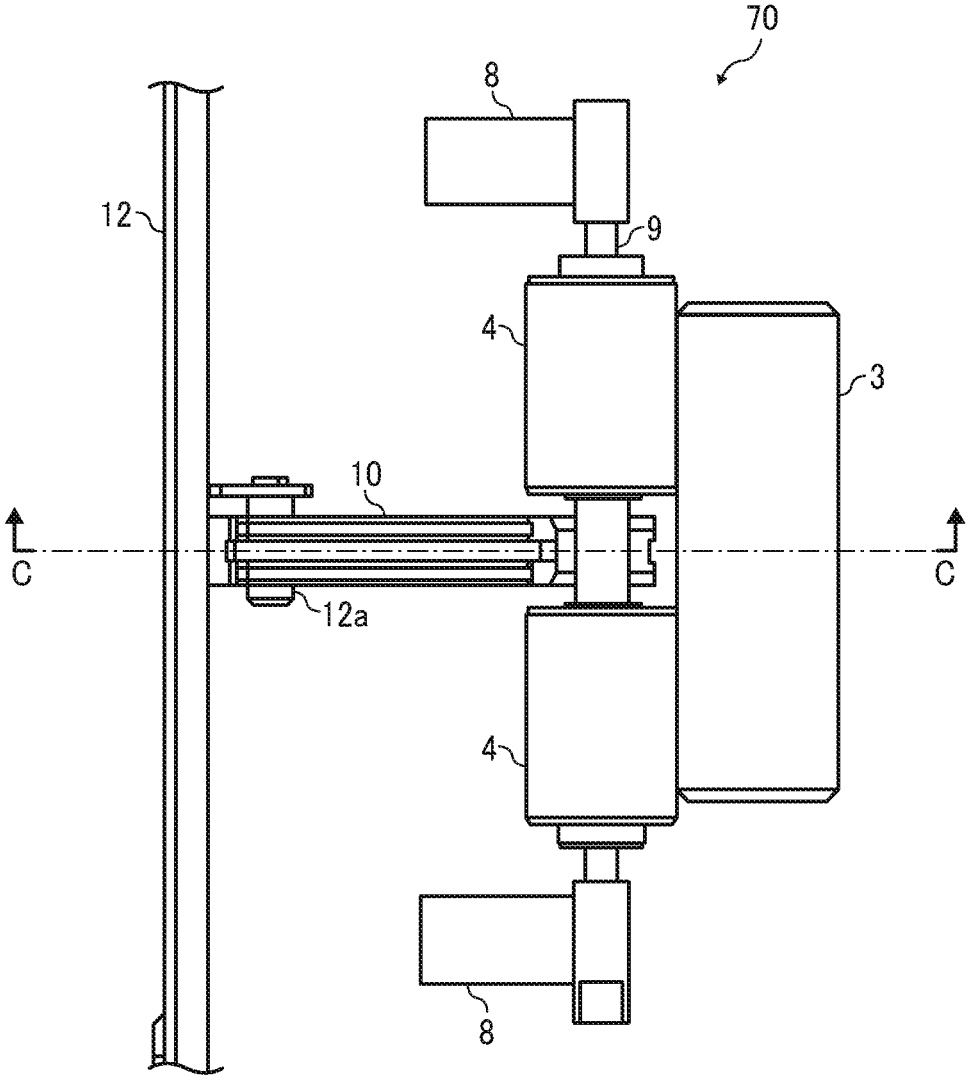
FIG. 9 is a plan view illustrating a sheet conveyance nip region of the pre-registration sheet conveying device viewed from top.
Figure 10A:
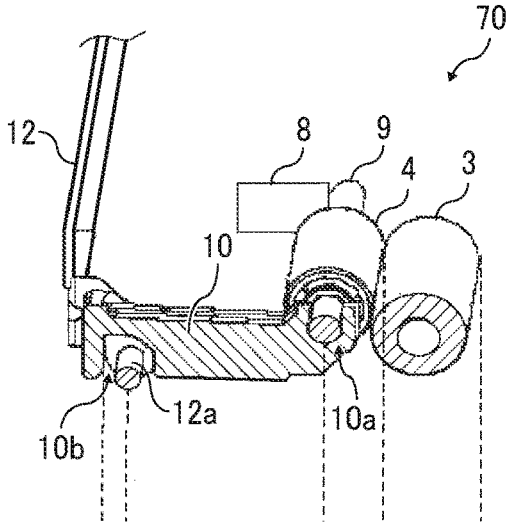
FIG. 10A is an enlarged perspective view illustrating the sheet conveyance nip region of the pre-registration sheet conveying device when the cover is in the closed state.
Figure 10B:
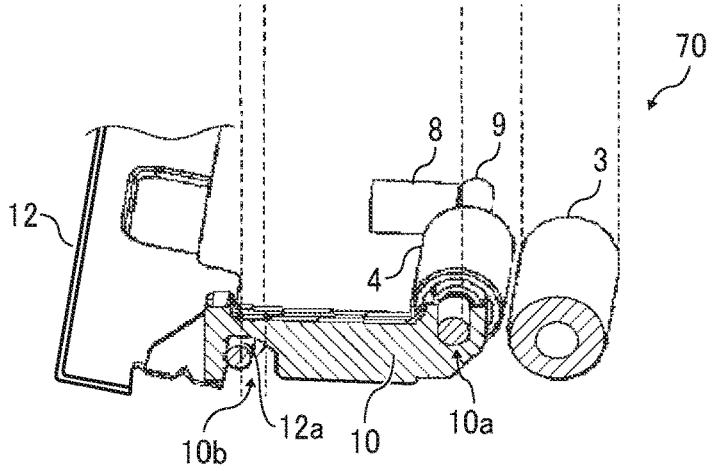
FIG. 10B is an enlarged perspective view illustrating the sheet conveyance nip region of the pre-registration sheet conveying device when the cover is in the open state.

FIG. 9 is a plan view illustrating the sheet conveyance nip region formed by the sheet conveying drive roller 3 and the sheet conveying driven roller 4 of the pre-registration sheet conveying device 70, viewed from top of the pre-registration sheet conveying device 70. FIGS. 10A and 10B are enlarged perspective views near the sheet conveyance nip region of the pre-registration sheet conveying device 70 along with a line C-C of FIG. 9. Specifically, FIG. 10A is an enlarged perspective view illustrating the sheet conveyance nip region of the pre-registration sheet conveying device 70 when the cover 11 is in the closed state in which the sheet conveyance nip region is formed between the sheet conveying drive roller 3 and the sheet conveying driven roller 4. FIG. 10B is an enlarged perspective view illustrating the sheet conveyance nip region of the pre-registration sheet conveying device 70 when the cover 11 is in the open state in which the sheet conveyance nip region is released and canceled.

It is to be noted that the cross section along the line C-C of FIG. 9 is at the same position as the cross section along the line B-B of FIG. 3.

Five (5) broken lines illustrated between FIG. 10A and FIG. 10B indicate respective positional changes of the parts and components in the apparatus body 110 of the image forming apparatus 100. In a case in which the members and components have been changed to different positions relative to the broken lines in FIGS. 10A and 10B, the positions of these parts and components change or shift in the apparatus body 110 of the image forming apparatus 100 due to the opening movement of the cover 11.

As described above, the connecting member 10 is supported by the guide face forming member 30 that is a part disposed in the apparatus body 110 of the image forming apparatus 100 and not moving along with the opening and closing movement of the cover 11. According to the nip releasing member 12 provided to the cover 11, the connecting member 10 is pulled when the cover 11 is opened. With this movement of the connecting member 10, the sheet conveying driven roller 4 is separated from the sheet conveying drive roller 3 against the biasing force applied by the pressure spring 8, and therefore the sheet conveyance nip region is released and canceled.

As illustrated in FIGS. 5, 10A, and 10B, the connecting member 10 includes a roller side connection recess 10*a* that connects the connecting member 10 and the roller holding shaft 9 that holds the sheet conveying driven roller 4. The connecting member 10 further includes a cover side connection recess 10*b* that connects the connecting member 10 and a nip releasing pin 12*a* of the nip releasing member 12 that is fixed to the cover 11.

Along with the movement of opening the cover 11, the nip releasing pin 12*a* shifts toward the left side of FIG. 10B from FIG. 10A relative to the apparatus body 110 of the image forming apparatus 100 and contacts a left side edge of the cover side connection recess 10*b* of the connecting member 10, as illustrated in FIG. 10B. As the nip releasing pin 12*a* further shifts toward the left side of FIG. 10A, the nip releasing pin 12*a* pulls the connecting member 10 toward the left side of FIG. 10A, and therefore the connecting member 10 shifts toward the further left side from the position in FIG. 10A to the position in FIG. 10B relative to the apparatus body 110 of the image forming apparatus 100. At this time, the right end of the roller side connection recess 10*a* contacts and presses the roller holding shaft 9 in a state illustrated in FIG. 10A, the roller holding shaft 9 is moved to the left side to change the position of roller holding shaft 9 to a state illustrated in FIG. 10B. Accordingly, the roller holding shaft 9 and the sheet conveying driven roller 4 held and supported by the roller holding shaft 9 are shifted to the left side from the state of FIG. 10A to the state of FIG. 10B. Consequently, the sheet conveyance nip region is released and canceled.

Even when a paper jam occurs in a state in which the sheet P is firmly held between the sheet conveying drive roller 3 and the sheet conveying driven roller 4 provided in the sheet conveying passage through which the sheet P travels, the sheet conveyance nip region can be released and canceled by opening the cover 11. Accordingly, the above-described configuration and operations can prevent the jammed sheet or jammed sheets from being torn and left in the apparatus body 110 of the image forming apparatus 100 during a paper jam handling operation.

The nip releasing member 12 is fixed to the cover 11 with a fixing body such as a screw or screws. The nip releasing member 12 is rotatable together with the cover 11 and opens with the cover 11 in the movement of opening the cover 11.

As an example, a comparative image forming apparatus, in which a sheet conveyance nip region is released and canceled along with an opening movement of a cover, includes a controller to detect the opening of the cover and control a solenoid that functions as a nip releasing body based on the detection result to release the sheet conveyance nip region. However, the comparative image forming apparatus further includes installation space to dispose a nip releasing mechanism such as an installation space for the solenoid having a certain thickness and an installation space for harnesses used to connect the solenoid. Further, addition of a solenoid that is an electronic device leads to an increase in cost of the image forming apparatus entirely.

By contrast, the image forming apparatus 100 according to the present embodiment of this disclosure includes the nip releasing member 12 that is fixed to the cover 11 and pulls the sheet conveying driven roller 4 via the connecting member 10 along with the opening movement of the cover 11. Since the image forming apparatus 100 according to the present embodiment of this disclosure does not include a solenoid that is installed in an expensive and large installation space to function as a nip releasing mechanism, the image forming apparatus 100 can achieve a space saving and inexpensive configuration to release the sheet conveyance nip region along with the opening movement of the cover 11.

Further, the image forming apparatus 100 according to the present embodiment of this disclosure includes the configuration in which the sheet conveying driven roller 4 is moved against the biasing force applied by the pressure spring 8. Therefore, the biasing force of the pressure spring 8 functions as a reaction force when the cover 11 is moved to open to be a braking force to prevent or restrain the cover 11 from being opened with a strong force. Consequently, the image forming apparatus 100 can do without a braking member to prevent a member such as the cover 11 from being damaged or broken due to a vigorous opening movement of the cover 11. Accordingly, the image forming apparatus 100 can achieve a space saving and inexpensive configuration that can prevent the member from being damaged when the member is opened.

Figure 1B:
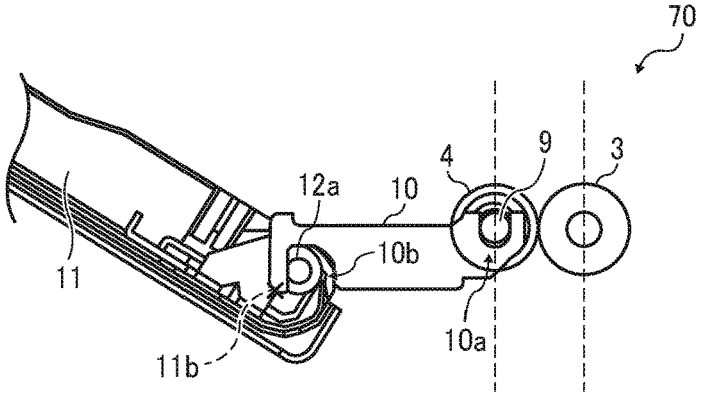
FIG. 1B is a diagram illustrating the connecting member and the sheet conveying driven roller when the cover is in the middle of an opening movement of the cover.
Figure 1C:
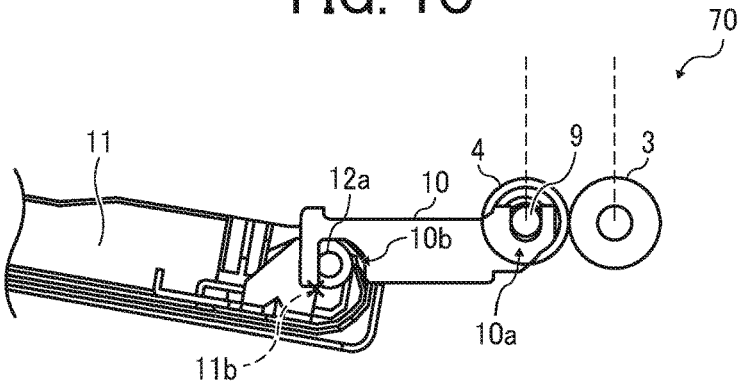
FIG. 1C is a diagram illustrating the connecting member and the sheet conveying driven roller when the cover is in an open state.

Now, a description is given of operations of the connecting member 10 and the sheet conveying driven roller 4 moving along with the opening movement of the cover 11 in the pre-registration sheet conveying device 70 along the line C-C of FIG. 9. Specifically, FIG. 1A is a diagram illustrating the connecting member 10 and the sheet conveying driven roller 4 that move together with the opening movement of the cover 11 in the pre-registration sheet conveying device 70 when the cover 11 is in the closed state. FIG. 1B is a diagram illustrating the connecting member 10 and the sheet conveying driven roller 4 when the cover 11 is in the middle of the opening movement. FIG. 1C is a diagram illustrating the connecting member 10 and the sheet conveying driven roller 4 when the cover 11 is in the open state after completion of the opening movement.

It is to be noted that hatch patterns indicating the cross section parts along the line C-C are omitted in FIGS. 1A, 1B, and 1C for convenience.

Two (2) broken lines illustrated across FIGS. 1A, 1B, and 1C indicate respective positional changes of the parts and components in the apparatus body 110 of the image forming apparatus 100. In a case in which the parts and components have been changed to different positions relative to the broken lines in FIG. 1A and FIG. 1C, the positions of these members and components change or shift in the apparatus body 110 of the image forming apparatus 100 due to the opening movement of the cover 11.

The position of the cover rotary axis 11*b* is indicated with a mark "x" in FIGS. 1A, 1B, and 1C. As illustrated in FIGS. 1A, 1B, and 1C, the nip releasing pin 12*a* is disposed at a position separated from the cover rotary axis 11*b*, and therefore the position of the nip releasing pin 12*a* relative to the apparatus body 110 of the image forming apparatus 100 changes along with the opening movement of the cover 11.

As illustrated in FIG. 1A, when the cover 11 is in the closed state, the nip releasing pin 12*a* is separated from the connecting member 10. Therefore, a force is not applied from the cover 11 to the connecting member 10 in this configuration. Consequently, the position of the nip releasing member 12 and the position of the cover 11 do not adversely affect the position of the sheet conveying driven roller 4. Accordingly, the position of the sheet conveying driven roller 4 relative to the sheet conveying drive roller 3 does not vary due to the part accuracy and the assembly accuracy of the nip releasing member 12 and the cover 11, and therefore the position of the nip releasing member 12 and the position of the cover 11 do not adversely affect the nip pressure of the sheet conveyance nip region.

Further, the nip releasing pin 12*a* does not contact the connecting member 10 immediately after the start of the opening movement of the cover 11 or at an early stage of the opening movement of the cover 11. The connecting member 10 is not pulled to the left side of FIGS. 1A, 1B, and 1C until the nip releasing pin 12*a* reaches the state illustrated in FIG. 1B. The nip releasing pin 12*a* contacts the connecting member 10 for the first time in the middle of the opening movement of the cover 11 as indicated in FIG. 1B. At this timing of contact with the connecting member 10, the nip releasing pin 12*a* starts to pull the connecting member 10 to the left side in FIGS. 1A, 1B, and 1C. For example, FIG. 1B illustrates the cover 11 that has opened at an angle of 60 degrees from the closed state. However, an opening angle of the nip releasing pin 12*a* to contact the connecting member 10 is not limited thereto.

As the cover 11 further opens from the state of FIG. 1B where the nip releasing pin 12*a* is in contact with the connecting member 10, a force of the nip releasing pin 12*a* to separate from the sheet conveying drive roller 3 is transmitted to the connecting member 10, which is a contacting state. By opening the cover 11 from the state illustrated in FIG. 1B, the nip releasing pin 12*a* pulls the sheet conveying driven roller 4 in a direction to separate from the sheet conveying drive roller 3 (i.e., the left side direction in FIGS. 1A, 1B, and 1C) via the connecting member 10. At this movement, the sheet conveying driven roller 4 separates from the sheet conveying drive roller 3, and thereby the sheet conveyance nip region is released and canceled. Accordingly, as illustrated in FIG. 1C, the sheet conveyance nip region formed between the sheet conveying drive roller 3 and the sheet conveying driven roller 4 is released and canceled in the state in which the opening movement of the cover 11 has been completed.

According to the above-described configuration, since a force opposing the biasing force applied by the pressure spring 8 does not work when the cover 11 is started to open by an operator such as a user of the image forming apparatus 100, it is not likely that the biasing force of the pressure spring 8 adversely affects an operating force used to release (separate to open) the cover 11.

Further, the cover 11 opens by rotating in the vertical direction about the cover rotary axis 11*b* that is substantially parallel to a horizontal direction. An upper end of the cover 11, which corresponds to a farthest side of the cover 11 from the cover rotary shaft 11*a*, rotates downwardly in the movement of opening the cover 11. With this configuration, at the position of the cover 11 in the middle of the opening movement of the cover 11 as illustrated in FIG. 1B, a moment is induced to open the cover 11 by falling in a direction indicated by arrow A in FIG. 1A along with the aid of the weight of the cover 11. With this moment, the nip releasing pin 12*a* pulls the connecting member 10 to the left side of FIGS. 1A, 1B, and 1C, so that the sheet conveying driven roller 4 is separated from the sheet conveying drive roller 3 against the biasing force applied by the pressure spring 8, thereby releasing and canceling the sheet conveyance nip region. Accordingly, even when the sheet conveyance nip region is released and canceled, it is not likely that the biasing force of the pressure spring 8 adversely affects the operating force used to release (separate to open) the cover 11.

In order to close the cover 11 from the open state as illustrated in FIG. 1C, the cover 11 is lifted so that the cover 11 rotates in a direction opposite the direction (a biasing direction) indicated by arrow A in FIG. 1A. At this time, the nip releasing pin 12*a* is shifted toward the sheet conveying drive roller 3, i.e., to the right side of FIGS. 1A, 1B, and 1C. Both the connecting member 10 and the sheet conveying driven roller 4, which have been pulled by the nip releasing pin 12*a* in a direction to separate from the sheet conveying drive roller 3, are moved toward the sheet conveying drive roller 3 (i.e., to the right side of FIGS. 1A, 1B, and 1C) by the biasing force of the pressure spring 8. Further, as the cover 11 is moved upwardly, the sheet conveying driven roller 4 contacts the sheet conveying drive roller 3 to form the sheet conveyance nip region. Consequently, the state changes to FIG. 1B in which a predetermined nip pressure works on the sheet conveyance nip region.

In the state illustrated in FIG. 1B, the sheet conveying driven roller 4 that is biased by the pressure spring 8 abuts against the sheet conveying drive roller 3 for positioning. Therefore, even when the cover 11 is moved further upwardly from the state illustrated in FIG. 1B and the nip releasing pin 12*a* continuously approaches the sheet conveying drive roller 3 (i.e., the right side of FIGS. 1A, 1B, and 1C), neither the connecting member 10 nor the sheet conveying driven roller 4 moves. Accordingly, when the cover 11 is moved further upwardly from the state illustrated in FIG. 1B, the nip releasing pin 12*a* is separated from an edge of the cover side connection recess 10*b* of the connecting member 10, resulting in disconnection of the nip releasing pin 12*a* and the connecting member 10.

Even when the cover 11 is moved while the nip releasing pin 12*a* and the connecting member 10 are being disconnected, the movement of the cover 11 does not adversely affect the position of the sheet conveying driven roller 4. Therefore, in the closed state as illustrated in FIG. 1A, the position of the nip releasing pin 12*a* on the cover 11 does not adversely affect the position of the sheet conveying driven roller 4. Accordingly, the position of the sheet conveying driven roller 4 relative to the sheet conveying drive roller 3 when forming the sheet conveyance nip region does not vary due to the part accuracy and the assembly accuracy of the cover 11, and therefore a desired nip pressure can be obtained. Accordingly, the nip pressure in the sheet conveyance nip region is stabilized. Therefore, the stability of the sheet conveyance is enhanced, and the frequency of occurrence of paper jams can be reduced.

In the above-described embodiment, a description of a configuration according this disclosure has been given of a configuration according to this disclosure regarding how to release and cancel the sheet conveyance nip region formed between the sheet conveying drive roller 3 and the sheet conveying driven roller 4, which correspond to a pair of sheet conveying rollers disposed upstream from the pair of registration rollers 5 that functions as a pair of sheet registration bodies in the sheet conveying direction of the sheet P. However, a sheet conveying body or sheet conveying bodies are not limited to the sheet conveying bodies of the above-described embodiment(s). For example, different nip regions formed between sheet conveying bodies such as a pair of registration rollers and a pair of rollers holding a belt therebetween in an image forming apparatus employing a direct transfer belt or an intermediate transfer belt are applicable to this disclosure.

In the above-described embodiment, as illustrated in FIG. 3, the connecting member 10 is disposed near a center of a width direction of the roller holding shaft 9 (i.e., the horizontal direction in FIG. 3 and a Y-axis direction). In a case in which it is difficult to dispose the connecting member 10 near the center of a roller, for example, when a roller to be separated is located inside a loop of an endless belt, the connecting member 10 is located at each end in the width direction of the roller so as to permit the roller to be separated. Accordingly, this configuration can achieve an effect same as the above-described embodiment.

As illustrated in FIGS. 1A, 1B, and 1C, a distance from the cover rotary axis 11*b* to the nip releasing pin 12*a* is sufficiently short relative to the size of the cover 11. In addition, the distance from the cover rotary axis 11*b* to the nip releasing pin 12*a* is sufficiently shorter than a distance from the cover rotary axis 11*b* to a handle that is used to open the cover 11. n this configuration, even though a distance of movement of the nip releasing pin 12*a* when opening the cover 11 is short, a relatively large force can be applied to the connecting member 10 according to the principle of leverage. Therefore, a relatively small force can be applied against the biasing force of a compression spring (i.e., the pressure spring 8) when opening the cover 11, and therefore the sheet conveyance nip region can be released and canceled.

In the image forming apparatus 100 according to the present embodiment of this disclosure, the nip releasing pin 12*a* and the connecting member 10 connect to each other by rotating the cover 11 by an angle of substantially 60 degrees from the closed state. Further, in a closing movement of the cover 11, the nip releasing pin 12*a* and the connecting member 10 are disconnected from each other at a position where the cover 11 comes to the position at the angle of substantially 60 degrees. It is to be noted that the position of the cover 11 at which the nip releasing pin 12*a* and the connecting member 10 are connected to each other during the opening movement and are disconnected from each other during the closing movement is not limited thereto.

For example, the image forming apparatus 100 further includes a locking pawl 11*c* disposed on the side of the cover 11 and a locking pawl engaging portion disposed on the side of the apparatus body 110 of the image forming apparatus 100. The locking pawl 11*c* and the locking pawl engaging portion form a lock mechanism to maintain the closed state of the cover 11. Then, in the opening movement of the cover 11, the cover 11 opens by releasing the lock mechanism including the locking pawl 11*c* and the locking pawl engaging portion and pulling the handle of the cover 11. When releasing the lock mechanism, the cover 11 moves in a direction in which the cover 11 opens. While the lock mechanism is being released, the cover 11 moves in a range to maintain a state in which the cover 11 and the connecting member 10 remain disconnected from each other. After the lock mechanism has been released, as the cover 11 moves to open, the cover 11 and the connecting member 10 are connected to each other.

As long as the cover 11 does not move together with the releasing movement of the lock mechanism and moves in the range that maintains the state in which the cover 11 and the connecting member 10 remain disconnected from each other while the locking mechanism is being released, this configuration can prevent the position of the cover 11 relative to the apparatus body 110 of the image forming apparatus 100 in the closed state of the cover 11 from adversely affecting the position of the sheet conveying driven roller 4. With this configuration, it can be prevented that the position of the sheet conveying driven roller 4 that functions as a second sheet conveying body relative to the sheet conveying drive roller 3 that functions as a first sheet conveying body is shifted when forming the sheet conveyance nip region between the sheet conveying drive roller 3 and the sheet conveying driven roller 4 due to a position accuracy of the cover 11.

In a state immediately after the release of the lock mechanism, an amount of positional shift in a lateral direction of the center of gravity of the cover 11 from the cover rotary axis 11*b* is relatively small. Therefore, a moment due to gravity of the cover 11 acting around the cover rotary axis 11*b* is relatively small. As the cover 11 inclines due to the opening movement thereof immediately after the release of the lock mechanism, the amount of positional shift in the lateral direction between the cover rotary axis 11*b* and the center of gravity of the cover 11 increases. Consequently, the moment due to gravity of the cover 11 acting around the cover rotary axis 11*b* also increases.

As described above with reference to FIGS. 1A, 1B, and 1C, in the configuration according to the present embodiment, the cover 11 and the connecting member 10 connect to each other when the opening movement of the cover 11 reaches a certain amount of the moment, and then the sheet conveying driven roller 4 moves along with the opening movement of the cover 11. According to this configuration, when the sheet conveying driven roller 4 is separated from the sheet conveying drive roller 3 against the biasing force applied by the pressure spring 8, the moment acting due to the own weight of the cover 11 can be used. As a result, the physical power of a user when opening the cover 11 can be reduced.

As illustrated in FIGS. 1A, 1B, and 1C, the connecting member 10 moves along with the opening movement of the cover 11, so as to move the sheet conveying driven roller 4 in the direction opposite the biasing direction of the pressure spring 8.

In a comparative image forming apparatus, a roller moves in a direction perpendicular to the biasing direction, and therefore a distance of movement of the roller becomes relatively long to release a sheet conveyance nip region formed between the roller and an opposing body.

By contrast, the image forming apparatus 100 employs a technique by which the sheet conveying driven roller 4 is moved to a direction opposite the biasing direction. By so doing, the sheet conveying driven roller 4 can be separated from the sheet conveying drive roller 3 in a smaller distance of movement of the sheet conveying driven roller 4, thereby releasing and canceling the sheet conveyance nip region.

In the above-described embodiment, a part where the position relative to the cover 11 is fixed (i.e., the nip releasing pin 12*a*) and a part where the position relative to the sheet conveying driven roller 4 is fixed (i.e., the roller holding shaft 9) are connected by one connecting member (i.e., the connecting member 10). The configuration and function of a connecting member are not limited to the connecting member 10 but this disclosure can be applied to multiple connecting members to pull the sheet conveying driven roller 4 along with the movement of opening the cover 11.

Some comparative image forming apparatuses include a cover that functions as a guide having a guide surface or as a sheet conveying roller holding member to hold a sheet conveying roller. In such comparative image forming apparatuses, the weight of the cover increases, and therefore high rigidity is required to the cover itself and to each member disposed on the side of the apparatus body 110 rotatably supporting the cover. In a case in which the cover has the high rigidity, the cover and the comparative image forming apparatus increase in size and the operability of the cover is deteriorated.

Further, in a case in which the sheet conveying roller is held by the cover, a complicated mechanism is provided to maintain the position accuracy of the pair of sheet conveying rollers when the cover is closed. This configuration results in an increase in manufacturing cost.

Specifically, in a comparative known image forming apparatus, a distance between a support to support a roller support member on a cover and a support to support a driven roller on the roller support member is a constant distance that is determined based on a length of the roller support member. For this reason, if a position of the support to support the roller support member on the cover relative to an apparatus body of the comparative image forming apparatus changes due to part accuracy and assembly accuracy, a position of the driven roller supported by the cover via the roller support member also changes. Accordingly, the position of the driven roller to the drive roller when forming a nip region changes, and therefore a desired nip pressure cannot be obtained.

By contrast, in the image forming apparatus 100 according to the present embodiment of this disclosure, the guide face forming member 30 that functions as a guide and a sheet conveying body retainer is provided as a separate body from the cover 11. Further, the guide face forming member 30 does not move along with the opening and closing movement of the cover 11 and remains fixed to the apparatus body 110 of the image forming apparatus 100 even when the cover 11 is opened. Therefore, the number of parts to open and close as the cover 11 can be retained to be smaller than the comparative image forming apparatus, and therefore an increase in size of the cover 11 and a degradation in operability of the cover 11 can be prevented. Further, since the position accuracy of the sheet conveying driven roller 4 is not susceptible to the position accuracy of the cover 11, the image forming apparatus 100 can do without a complicated mechanism to maintain the position accuracy of the sheet conveying driven roller 4 and the sheet conveying drive roller 3, and therefore can enhance a reduction in manufacturing cost.

As illustrated in FIG. 5, the cover side connection recess 10*b* that functions as a connecting portion that connects the connecting member 10 and the cover 11 to each other is a cut portion formed in the connecting member 10 and opening downwardly in FIG. 5. Further, the roller side connection recess 10*a* that functions as a connecting portion that connects the connecting member 10 and the sheet conveying driven roller 4 to each other is a cut portion formed in the connecting member 10 and opening upwardly in FIG. 5. Respective directions of openings of the roller side connection recess 10*a* and the cover side connection recess 10*b* are not limited thereto. For example, the roller side connection recess 10*a* may open upwardly and the cover side connection recess 10*b* may open downwardly. Alternatively, as long as the connecting member 10 has a shape that can release the connection of the connecting member 10 and the cover 11, in other words, a shape that can separate the connecting member 10 and the cover 11 from each other, the connecting member 10 may have no cut portions but has a hole shape surrounding the nip releasing pin 12*a*.

As described above, the present embodiment shows an example that a sheet that is fed and conveyed by the pre-registration sheet conveying device 70 that functions as a sheet conveying device corresponds to the sheet P that functions as a recording medium. However, a sheet that is fed and conveyed by a sheet conveying device is not limited thereto but includes a regular paper material such as plain paper, thick paper, post card, envelope, thin paper, coated paper, art paper, label sheet, OHP (overhead projector) transparent film sheet, recording sheet and film.

The configurations according to the above-descried embodiments are not limited thereto. This disclosure can achieve the following aspects effectively.

Aspect A.

In Aspect A, a sheet conveying device (for example, the pre-registration sheet conveying device 70) includes a first sheet conveying body (for example, the sheet conveying drive roller 3), a second sheet conveying body (for example, the sheet conveying driven roller 4), a cover (for example, the cover 11), and a connecting body (for example, the connecting member 10). The first sheet conveying body is configured to rotate and apply a conveying force to a sheet (for example, the sheet P). The second sheet conveying body is configured to contact the first sheet conveying body and to form a nip region together with the first sheet conveying body. The cover is configured to open and close with respect to an apparatus body (for example, the apparatus body 110) of an image forming apparatus (for example, the image forming apparatus 100). The second sheet conveying body is configured to separate from the first sheet conveying body along with an opening movement of the cover. The connecting body is configured to connect the cover and the second sheet conveying body. The connecting body includes a first connecting portion (for example, the roller side connection recess 10*a*) connected to the cover and a second connecting portion (for example, the cover side connection recess 10*b*) connected to the second sheet conveying body. At least one of a connection of the cover and the first connecting portion of the connecting body and a connection of the second sheet conveying body and the second connecting portion of the connecting body is released when the cover is closed with respect to the apparatus body of the image forming apparatus. The connecting body is brought into connection with either one of the cover and the second sheet conveying body in the middle of the opening movement of the cover.

According to this configuration, as described in the above-described embodiment, when the cover is in the closed state while the nip region is formed between the first sheet conveying body and the second sheet conveying body, the connection of the cover and the second sheet conveying body is released. Consequently, the position of the cover relative to the apparatus body does not adversely affect the position of the second sheet conveying body relative to the apparatus body. Accordingly, this configuration can prevent variation of the position of the second sheet conveying body relative to the first sheet conveying body when forming the nip region. Further, since the at least one of the connecting portions that have been released in the middle of the opening movement of the cover are connected again, the second sheet conveying body can be separated from the first sheet conveying body along with the opening movement of the cover after completion of the connection. Therefore, according to the configuration in which the second sheet conveying body is separated from the first sheet conveying body along with the opening movement of the cover, the position of the second sheet conveying body relative to the first second sheet conveying body when forming the sheet conveying nip region does not vary due to the part accuracy and the assembly accuracy of the cover.

Further, in Aspect A, since a force to separate the second sheet conveying body from the first sheet conveying body does not work immediately after the start of the opening movement of the cover but works in the middle of the opening movement of the cover, the force is relatively small at the start of the opening movement of the cover, and therefore the operability of the cover in the opening movement can be enhanced.

Aspect B.

In Aspect A, the connecting body further includes a third connecting portion (for example, the nip releasing pin 12*a*) configured to contact the cover. A position of the third connecting portion relative to the apparatus body of the image forming apparatus changes as the cover opens. The third connecting portion is configured to contact a connecting position at which the third connecting portion contacts the second connecting portion and to move in a direction in which the second sheet conveying body separates from the first sheet conveying body via the connecting body as the cover further opens.

According to this configuration, as described in the above-described embodiment, the configuration can achieve that the connecting portion that has been released in the in the middle of the opening movement of the cover connects again.

Aspect C.

In Aspect B, the cover includes a rotary axis (for example, the cover rotary axis 11*b*) about which the cover rotates and opens and close relative to the apparatus body of the image forming apparatus. The third connecting portion (for example, the nip releasing pin 12*a*) rotates about the rotary axis of the cover along with the opening movement of the cover.

According to this configuration, as described in the above-described embodiments, the configuration can achieve that the positional shift of the third connecting portion relative to the apparatus body by performing the opening movement of the cover.

Aspect D.

In Aspect C, the cover (for example, the cover 11) opens and closes vertically about the rotary axis (for example, the cover rotary axis 11*b*) extending parallel to a horizontal direction.

According to this configuration, as described in the above-described embodiment, a moment due to gravity of the cover can be used as a force to move the connecting body (for example, the connecting member 10) that separates the second sheet conveying body (for example, the sheet conveying driven roller 49 from the first sheet conveying body (for example, the sheet conveying drive roller 3).

A direction to open and close the cover is not limited to a vertical direction that opens and closes upwardly and downwardly about the rotary axis. For example, a cover that opens and closes in a horizontal direction (i.e., directions to the left and right sides) about a rotary axis extending parallel to the vertical direction can also be applied to this disclosure. This configuration can also connect the connecting portion that has been released in the middle of the opening movement of the cover.

Aspect E.

In any of Aspect A through Aspect D, the sheet conveying device (for example, the pre-registration sheet conveying device 70) further includes a biasing body (for example, the pressure spring 8) configured to bias the second sheet conveying body (for example, the sheet conveying driven roller 4) in a biasing direction toward the first sheet conveying body (for example, the sheet conveying drive roller 3).

According to this configuration, as described in the above-described embodiment, the nip pressure in the nip region (for example, the sheet conveyance nip region) is stabilized. Therefore, the stability of the sheet conveyance is enhanced, and the frequency of occurrence of paper jams can be reduced.

The configuration in which the nip region is formed between the first sheet conveying body and the second sheet conveying body is not limited thereto. For example, a configuration in which the second sheet conveying body is disposed upper than the first sheet conveying body and the nip region is formed between the first sheet conveying body and the second sheet conveying body with the aid of gravity of the second sheet conveying body may be applied to this disclosure.

Aspect F.

In Aspect E, the connecting body (for example, the connecting member 10) moves along with the opening movement of the cover (for example, the cover 11) and causes the second sheet conveying body (for example, the sheet conveying driven roller 4) to move in a direction opposite the biasing direction of the biasing body (for example, the pressure spring 8).

According to this configuration, as described in the above-described embodiment, the second sheet conveying body is separated from the first sheet conveying body with a smaller distance when compared with the comparative image forming apparatus, thereby releasing and canceling the nip region.

Aspect G.

In any of Aspect A through Aspect F, the sheet conveying device (for example, the pre-registration sheet conveying device 70) further includes a guide (for example, the guide face forming member 30) and a second sheet conveying body retainer (for example, the guide face forming member 30). The guide is configured to form a sheet conveyance passage having the nip region (for example, the sheet conveyance nip region). The second sheet conveying body retainer is configured to retain the second sheet conveying body (for example, the sheet conveying driven roller 4). The guide and the second sheet conveying body retainer are separate bodies separate from the cover (for example, the cover 11) and do not move along with a movement of opening and closing the cover.

According to this configuration, as described in the above-described embodiments, an increase in size of the cover and a degradation in operability the operability of the cover can be prevented.

Aspect H.

In Aspect H, an image forming apparatus (for example, the image forming apparatus 100) includes a sheet conveying device and an image forming device (for example, the image forming device 50) configured to form the image on the sheet conveyed by the sheet conveying device. In the image forming apparatus, the sheet conveying device includes the sheet conveying device (for example, the pre-registration sheet conveying device 70) according to any one of Aspect A through Aspect G.

According to this configuration, as described in the above-described embodiment, the nip pressure in the nip region is stabilized. Therefore, the stability of the sheet conveyance is enhanced, and the frequency of occurrence of paper jams can be reduced.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a first sheet conveying body configured to rotate and apply a conveying force to a sheet;

a second sheet conveying body configured to contact the first sheet conveying body and to form a nip region together with the first sheet conveying body;

a cover configured to open and close with respect to an apparatus body of an image forming apparatus, the second sheet conveying body configured to separate from the first sheet conveying body along with an opening movement of the cover; and a connecting body configured to connect the cover and the second sheet conveying body, the connecting body including a first connecting portion connected to the cover and a second connecting portion connected to the second sheet conveying body, at least one of a connection of the cover and the first connecting portion of the connecting body and a connection of the second sheet conveying body and the second connecting portion of the connecting body is released when the cover is closed with respect to the apparatus body of the image forming apparatus, and the connecting body being brought into connection with either one of the cover and the second sheet conveying body, wherein the connecting body further includes a third connecting portion configured to contact the cover, wherein a position of the third connecting portion relative to the apparatus body of the image forming apparatus changes as the cover opens, wherein the third connecting portion is configured to contact a connecting position at which the third connecting portion contacts the second connecting portion and to move in a direction in which the second sheet conveying body separates from the first sheet conveying body via the connecting body as the cover further opens, wherein the cover includes a rotary axis about which the cover rotates and opens and close relative to the apparatus body of the image forming apparatus, and wherein the third connecting portion rotates about the rotary axis of the cover along with the opening of the cover.

2. The sheet conveying device according to claim 1, wherein the cover opens and closes vertically about the rotary axis extending parallel to a horizontal direction.

3. The sheet conveying device according to claim 2, further comprising a biasing body configured to bias the second sheet conveying body in a biasing direction toward the first sheet conveying body.

4. An image forming apparatus comprising:

the sheet conveying device according to claim 3; and an image forming device configured to form an image on the sheet conveyed by the sheet conveying device.

5. The sheet conveying device according to claim 2, further comprising:

a guide configured to form a sheet conveyance passage having the nip region; and a second sheet conveying body retainer configured to retain the second sheet conveying body, wherein the guide and the second sheet conveying body are separate bodies separate from the cover and do not move along with a movement of opening and closing the cover.

6. An image forming apparatus comprising:

the sheet conveying device according to claim 2; and an image forming device configured to form an image on the sheet conveyed by the sheet conveying device.

7. The sheet conveying device according to claim 1, further comprising a biasing body configured to bias the second sheet conveying body in a biasing direction toward the first sheet conveying body.

8. An image forming apparatus comprising:

the sheet conveying device according to claim 1; and an image forming device configured to form an image on the sheet conveyed by the sheet conveying device.

9. The sheet conveying device according to claim 1, further comprising:

a guide configured to form a sheet conveyance passage having the nip region; and a second sheet conveying body retainer configured to retain the second sheet conveying body, wherein the guide and the second sheet conveying body are separate bodies separate from the cover and do not move along with a movement of opening and closing the cover.

10. A sheet conveying device comprising:

a first sheet conveying body configured to rotate and apply a conveying force to a sheet;

a second sheet conveying body configured to contact the first sheet conveying body and to form a nip region together with the first sheet conveying body;

a cover configured to open and close with respect to an apparatus body of an image forming apparatus, the second sheet conveying body configured to separate from the first sheet conveying body along with an opening movement of the cover; and a connecting body configured to connect the cover and the second sheet conveying body, the connecting body including a first connecting portion connected to the cover and a second connecting portion connected to the second sheet conveying body, at least one of a connection of the cover and the first connecting portion of the connecting body and a connection of the second sheet conveying body and the second connecting portion of the connecting body is released when the cover is closed with respect to the apparatus body of the image forming apparatus, the connecting body being brought into connection with either one of the cover and the second sheet conveying body, wherein the connecting body further includes a third connecting portion configured to contact the cover, wherein a position of the third connecting portion relative to the apparatus body of the image forming apparatus changes as the cover opens, wherein the third connecting portion is configured to contact a connecting position at which the third connecting portion contacts the second connecting portion and to move in a direction in which the second sheet conveying body separates from the first sheet conveying body via the connecting body as the cover further opens, wherein the sheet conveying device further includes a guide configured to form a sheet conveyance passage having the nip region, wherein the sheet conveying device further includes a second sheet conveying body retainer configured to retain the second sheet conveying body, and wherein the guide and the second sheet conveying body are separate bodies separate from the cover and do not move along with a movement of opening and closing the cover.

* * * * *